US011468829B2

(12) United States Patent
Kim et al.

(10) Patent No.: US 11,468,829 B2
(45) Date of Patent: Oct. 11, 2022

(54) DISPLAY DEVICE

(71) Applicant: LG Display Co., Ltd., Seoul (KR)

(72) Inventors: Seunghyun Kim, Paju-si (KR); Yuhoon Kim, Paju-si (KR); Junggeun Jo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/467,085

(22) Filed: Sep. 3, 2021

(65) Prior Publication Data

US 2022/0084462 A1 Mar. 17, 2022

(30) Foreign Application Priority Data

Sep. 17, 2020 (KR) ..... 10-2020-0119921

(51) Int. Cl.
*G09G 3/32* (2016.01)

(52) U.S. Cl.
CPC ..... *G09G 3/32* (2013.01); *G09G 2300/0452* (2013.01); *G09G 2310/027* (2013.01); *G09G 2310/08* (2013.01); *G09G 2320/0233* (2013.01); *G09G 2340/00* (2013.01)

(58) Field of Classification Search
CPC ... G09G 2300/0452; G09G 2320/0233; G09G 2310/027; G09G 3/32; G09G 2310/08; G09G 2340/00
See application file for complete search history.

(56) References Cited

U.S. PATENT DOCUMENTS 8,326,051 B1 * 12/2012 Hobbs ..... H04N 1/4092 382/232
2004/0189661 A1 * 9/2004 Perry ..... G06T 11/203 345/611
2005/0219247 A1 * 10/2005 Arnold ..... G06F 40/126 345/467
2012/0288190 A1 * 11/2012 Tang ..... G06V 30/146 382/199

FOREIGN PATENT DOCUMENTS

KR 10-2017-0038283 A 4/2017

* cited by examiner

*Primary Examiner* — Muhammad N Edun
(74) *Attorney, Agent, or Firm* — Fenwick & West LLP

(57) ABSTRACT

A display device is proposed. The display device includes unit pixels in which red, white, blue, and green sub-pixels are sequentially arranged, and includes an image processor configured to detect text from an image signal input from outside, perform image processing on the text, and output the text, wherein in the unit pixels respectively corresponding to both edges of the text, the image processor may perform image processing so that predetermined sub-pixels adjacent to a central part of the text are driven in a light-emitting state.

18 Claims, 16 Drawing Sheets

DISPLAY DEVICE

CROSS REFERENCE TO RELATED APPLICATION

The present application claims priority to Korean Patent Application No. 10-2020-0119921, filed Sep. 17, 2020, the entire contents of which is incorporated herein for all purposes by this reference.

BACKGROUND OF THE INVENTION

Field of the Invention

The present invention relates to a display device and, more particularly, to a display device capable of improving resolution of text in an image.

Description of the Related Art

Recently, display devices have been widely used not only in TVs but also in small electronic devices such as monitors, mobile phones, and wearable devices. In small electronic devices, there is a concern that readability of text may be reduced when using a display device. In order to solve this problem, technologies such as ClearType and CoolType have been developed. Among the technologies, ClearType is a technology that renders the text more smoothly by applying anti-aliasing.

Recently, a four-color type display device has been developed, wherein an image is expressed in high quality by using colors including red, green, blue, and white. Since such ClearType is based on a three-color display device expressing red, green, and blue, when ClearType is realized in the four-color display device, the readability may be reduced rather than enhanced.

SUMMARY OF THE INVENTION

An objective of the present invention is to provide a four-color type display device that realizes text in ClearType without deteriorating display quality.

Another objective of the present invention is to provide a display device provided with an image processor that converts an image signal including text rendered in ClearType into the image signal appropriate for the display device having a four-color type.

A display device according to an exemplary embodiment includes unit pixels in which red, white, blue, and green sub-pixels are sequentially arranged. The display device includes: an image processor configured to detect text from an image signal input from outside, perform image processing on the text, and output the text, wherein the image processor performs the image processing so that predetermined sub-pixels adjacent to a central part of the text are driven in a light-emitting state in the unit pixels respectively corresponding to both edges of the text.

The image processor may perform the image processing so that white, blue, and green sub-pixels are driven in the light-emitting state in the unit pixels corresponding to a left edge of the text, and red, white, and blue sub-pixels are driven in the light-emitting state in the unit pixels corresponding to a right edge of the text.

The image signal may include grayscale data for red, green, and blue sub-pixels.

The image processor may include: a text detector configured to detect the text from the image signal; a data converter configured to convert at least one of a luminance component, a chrominance component, and a grayscale value of the detected text; and a data relocator configured to relocate the converted image signal according to an arrangement order of the sub-pixels.

The display device may further include: a first color gamut converter configured to convert the image signal into a YCbCr color gamut having the luminance component, a first chrominance component, and a second chrominance component, wherein, when the first chrominance component is greater than the second chrominance component in a first unit pixel, and the first chrominance component is smaller than the second chrominance component in a second unit pixel adjacent to the first unit pixel, and the luminance component has a maximum value in a third unit pixel arranged between the first unit pixel and the second unit pixel, the text detector may detect the first unit pixel as the left edge and detect the second unit pixel as the right edge.

When the grayscale value gradually increases or decreases and then gradually decreases or increases among a first unit pixel, a second unit pixel adjacent to the first unit pixel, and a third unit pixel adjacent to the second unit pixel, the text detector may detect the first unit pixel as the left edge and detect the third unit pixel as the right edge.

The data converter may decrease at least one of the chrominance component, the luminance component, and the grayscale value of each of both edges.

The data converter may further increase at least one of the luminance component and the grayscale value of the central part.

The data converter may adjust grayscale values so that a ratio of each grayscale value of red, green, and blue in the central part and both edges is approximated to 1:1:1.

The data relocator may correct the relocated data from the converted image signal so that the luminance and grayscale are highest in the central part and the luminance and grayscale gradually decrease toward each of both edges.

For the right edge, the data relocator may convert green grayscale data into blue grayscale data.

The text may be a ClearType text.

A display device according to another exemplary embodiment includes: a display panel including unit pixels in which red, white, blue, and green sub-pixels are sequentially arranged; an image processor configured to detect text from an image signal input from outside, perform image processing on the text, and output the text; a timing controller configured to process and output the image signal received from the image processor according to an operation condition of the display panel; and a data driver configured to apply, to the sub-pixels, a data signal corresponding to the image signal received from the timing controller, wherein in the unit pixels respectively corresponding to both edges of the text, the display panel emits light of predetermined sub-pixels adjacent to a central part of the text.

The predetermined sub-pixels may include white, blue, and green sub-pixels in the unit pixels corresponding to a left edge of the text, and include red, white, and blue sub-pixels in the unit pixels corresponding to a right edge of the text.

The image signal may include red, green, and blue grayscale data.

The image processor may include: a first color gamut converter configured to convert the red, green, and blue grayscale data into data having a luminance component, a first chrominance component, and a second chrominance component; a text detector configured to detect the text from the converted data; a data converter configured to convert at least one of the luminance component and the chrominance components of the detected text; a second color gamut converter configured to convert the converted data into red, green, blue, and white grayscale data; and a data relocator configured to relocate the converted red, green, blue, and white grayscale data in an order of red, white, blue, and green grayscale data.

The data converter may decrease at least one of the chrominance component, the luminance component, and a grayscale value of each of both edges.

The data converter may further increase the luminance component of the central part.

The data converter may adjust the grayscale value so that a ratio of each grayscale value of red, green, and blue in the central part and both edges is approximated to 1:1:1.

The data relocator may correct the relocated data from the converted image signal so that the luminance and grayscale are highest in the central part and the luminance and grayscale gradually decrease toward each of the both edges, and converts, for the right edge, green grayscale data into blue grayscale data.

The display device according to the exemplary embodiment may effectively realize a ClearType text in the display device having the four-color type.

In addition, the display device according to the exemplary embodiment may improve the resolution and readability of the text on the display device.

DETAILED DESCRIPTION OF THE INVENTION

Figure 1:
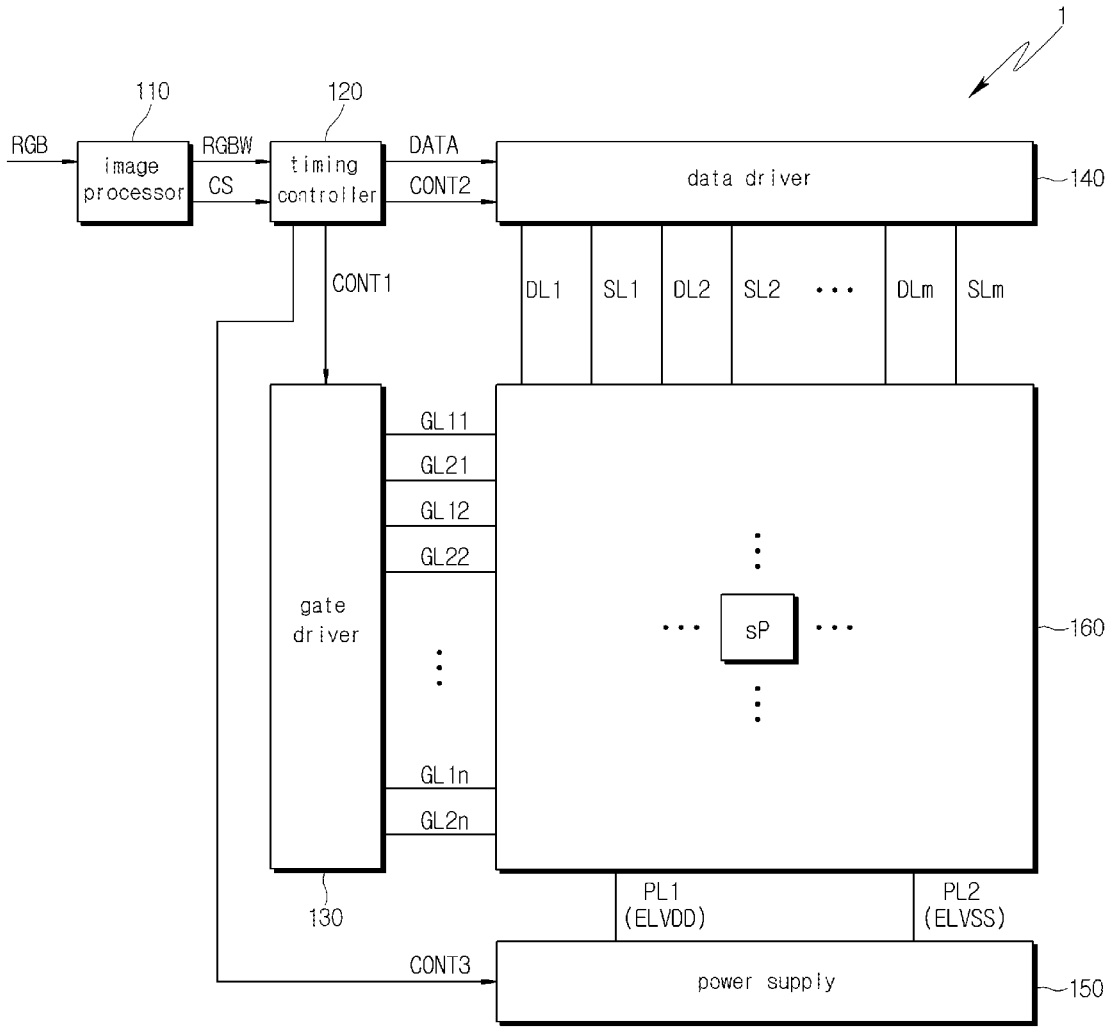
FIG. 1 is a block diagram showing a configuration of a display device.

Hereinafter, exemplary embodiments will be described with reference to the views. In this specification, when a first component (or area, layer, part, etc.) is referral to as being "on", "connected to", or "coupled with" a second component, it means that the first component can be directly connected to/coupled to the second component, or a third component can be disposed between the first and second components.

The same reference numerals refer to the same components. In addition, in the drawings, the thickness, proportion, and dimensions of the components are exaggerated for effective description of the technical content "And/or" includes all combinations of one or more of which the associated configurations may be defined.

Although the terms "first", "second", etc. may be used herein to describe various components, these components should not be limited by these terms. These terms are only used for the purpose of distinguishing one element from another element. For example, the first component may be referred to as a second component without departing from the scope of the present exemplary embodiments, and similarly, the second component may be referred to as a first component. As used herein, the singular forms are intended to include the plural forms as well, unless the context clearly indicates otherwise.

It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

FIG. 1 is a block diagram showing a configuration of a display device.

Referring to FIG. 1, the display device 1 includes an image processor 110, a timing controller 120, a gate driver 130, a data driver 140, a power supply 150, and a display panel 160.

The image processor 110 processes and outputs an image signal RGB supplied from the outside. The image signal RGB may include a plurality of grayscale data. In particular, in the following exemplary embodiments, the image signal RGB may be an image signal RGB including text to which ClearType is applied. In such exemplary embodiments, the image processor 110 may detect the text from the image signal RGB and perform image processing in order to improve resolution of the text. A detailed operation of the image processor 110 will be described below with reference to the views.

In the exemplary embodiment, the image processor 110 may further output a control signal CS such as a data enable signal, a horizontal synchronization signal, a vertical synchronization signal, and a clock signal. In another exemplary embodiment, the control signal CS may be generated by an external device other than the image processor 110.

The timing controller 120 may receive an image signal RGBW from the image processor 110. In addition, the timing controller 120 may receive the control signal CS from the image processor 110 or the external device. The timing controller 120 processes the image signal RGBW and the control signal CS to be suitable for operation conditions of the display panel 160, thereby generating and outputting image data DATA, a gate driving control signal CONT1, a data driving control signal CONT2, and a power supply control signal CONT3.

The gate driver 130 may be connected to sub-pixels sP of the display panel 160 through a plurality of first gate lines GL11 to GL1*n*. The gate driver 130 may generate gate signals on the basis of the gate driving control signal CONT1 output from the timing controller 120. The gate driver 130 may provide the generated gate signals to the sub-pixels sP through the plurality of first gate lines GL11 to GL1*n*.

In various exemplary embodiments, the gate driver 130 may be further connected to the sub-pixels sP of the display panel 160 through a plurality of second gate lines GL21 to GL2*n*. The gate driver 130 may provide sensing signals to the sub-pixels sP through the plurality of second gate lines GL21 to GL2*n*. The sensing signal may be supplied to measure characteristics of a driving transistor and/or a light-emitting device provided inside of the sub-pixels sP.

The data driver 140 may be connected to the sub-pixels sP of the display panel 160 through a plurality of data lines DL1 to DLm. The data driver 140 may generate data signals on the basis of the image data DATA and the data driving control signals CONT2, which are output from the timing controller 120. The data driver 140 may provide the generated data signals to the sub-pixels sP through the plurality of data lines DL1 to DLm.

In various exemplary embodiments, the data driver 140 may be further connected to the sub-pixels sP of the display panel 160 through a plurality of sensing lines (or reference lines) SL1 to SLm. The data driver 140 may provide a reference voltage (or sensing voltage, or initialization voltage) to the sub-pixels sP through the plurality of sensing lines SL1 to SLm, or may sense states of the sub-pixels sP on the basis of electrical signals fed back from the sub-pixels sP.

The power supply 150 may be connected to the sub-pixels sP of the display panel 160 through a plurality of power lines PL1 and PL2. The power supply 150 may generate a driving voltage to be provided to the display panel 160 on the basis of the power supply control signal CONT3. The driving voltage may include, for example, a high potential driving voltage ELVDD and a low potential driving voltage ELVSS. The power supply 150 may provide the generated driving voltages ELVDD and ELVSS to the sub-pixels sP through the corresponding power lines PL1 and PL2.

The plurality of sub-pixels sP are arranged on the display panel 160. For example, the sub-pixels SP may be arranged in a matrix form on the display panel 160.

Each sub-pixel sP may be electrically connected to the corresponding gate line and data line. Such sub-pixels sP may emit light with luminance corresponding to gate signals and data signals respectively supplied through the first gate lines GL11 to GL1*n* and the data lines DL1 to DLm.

The sub-pixels sP may be configured to display any one of four or more colors. For example, each sub-pixel sP may display any one of red, green, blue, and white colors. In such an exemplary embodiment, red, green, blue, and white sub-pixels sP may constitute one unit pixel.

Each of the components including the timing controller 120, the gate driver 130, the data driver 140, and the power supply 150 may be constituted by a separate integrated circuit (IC), or by an integrated circuit in which at least some components are combined with each other. For example, an integrated circuit in which at least one of the data driver 140 and the power supply 150 is combined with the timing controller 120 may be configured.

In addition, in FIG. 1, although the gate driver 130 and the data driver 140 are shown as separate components from the display panel 160, at least one of the gate driver 130 and the data driver 140 may be constituted in an in-panel method in which at least one component is integrally provided with the display panel 160. For example, the gate driver 130 may be integrally provided with the display panel 160 according to a Gate In Panel (GIP) method.

Figure 2:
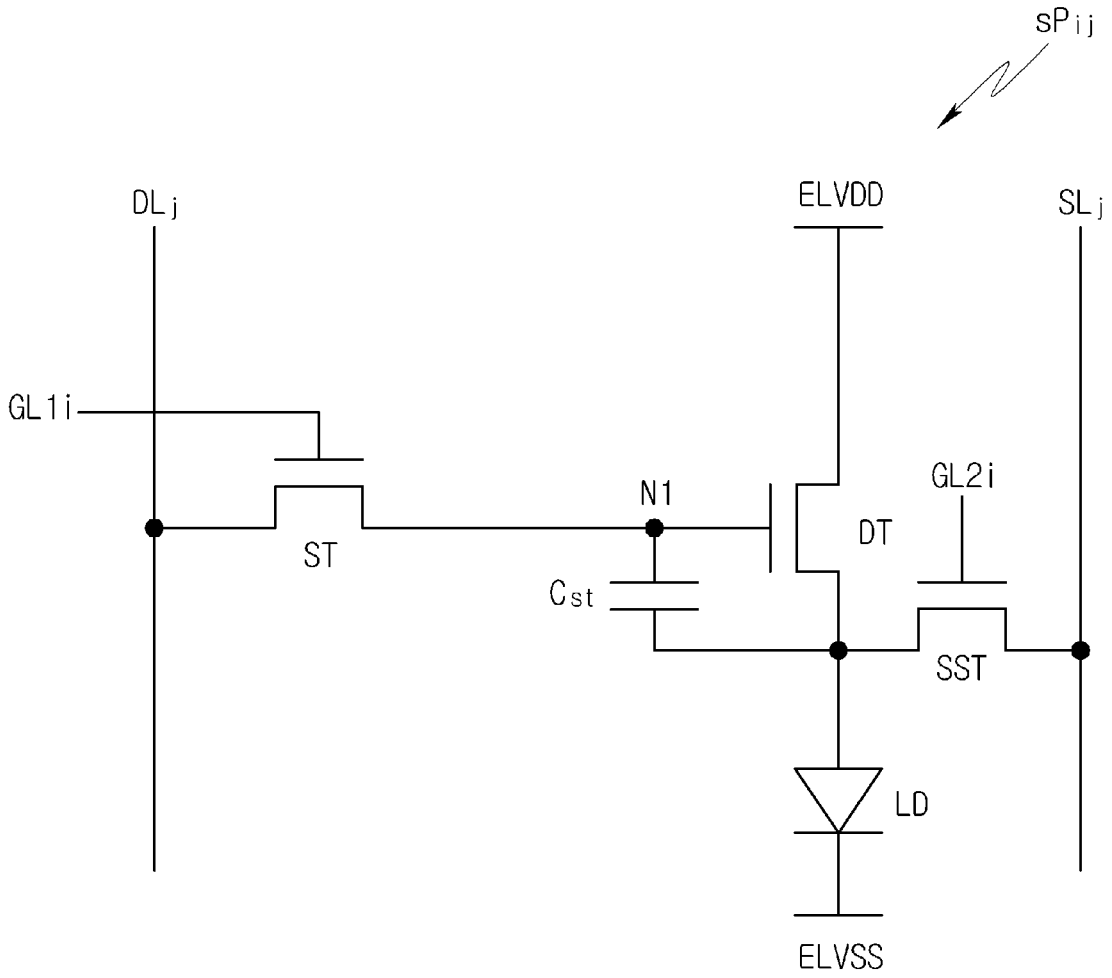
FIG. 2 is a circuit diagram showing an exemplary embodiment of a sub-pixel shown in FIG. 1.

FIG. 2 is a circuit diagram showing an exemplary embodiment of a sub-pixel shown in FIG. 1. FIG. 2 shows an example of a sub-pixel $sP_{ij}$ connected to the i-th gate lines GL1*i* and GL2*i*, and the j-th data line $DL_j$.

Referring to FIG. 2, the sub-pixel $sP_{ij}$ includes a switching transistor ST, a driving transistor DT, a sensing transistor SST, a storage capacitor Cst, and a light-emitting device LD.

The first electrode (for example, drain electrode) of the switching transistor ST is electrically connected to the j-th data line $DL_j$, and the second electrode (for example, source electrode) is electrically connected to the first node N1. The gate electrode of the switching transistor ST is electrically connected to the i-th first gate line GL1*i*. The switching transistor ST is turned on when a gate signal of a gate-on level is applied to the i-th first gate line GL1*i*, and transmits the data signal applied to the j-th data line $DL_j$ to the first node N1.

The first electrode of the storage capacitor Cst is electrically connected to the first node N1, and the second electrode is electrically connected to the first electrode of the light-emitting device LD. The storage capacitor Cst may be charged with a voltage corresponding to a difference between the voltage applied to the first node N1 and the voltage applied to the first electrode of the light-emitting device LD.

The first electrode (for example, drain electrode) of the driving transistor DT is configured to receive the high potential driving voltage ELVDD, and the second electrode (for example, source electrode) is electrically connected to the first electrode (for example, anode electrode) of the light-emitting device LD. The gate electrode of the driving transistor DT is electrically connected to the first node N1. The driving transistor DT is turned on when voltage of the gate-on level is applied through the first node N1, and may control the amount of driving current flowing through the light-emitting device LD in response to the voltage provided to the gate electrode.

The first electrode (for example, drain electrode) of the sensing transistor SST is electrically connected to the j-th sensing line $SL_j$, and the second electrode (for example, source electrode) is electrically connected to the first electrode (for example, anode electrode) of the light-emitting device LD. The gate electrode of the sensing transistor SST is electrically connected to the i-th second gate line GL2*i*. The sensing transistor SST is turned on when a sensing signal of a gate-on level is applied to the i-th second gate line GL2*i*, and transfers the reference voltage applied to the j-th sensing line $SL_j$ to the first electrode of the light-emitting device LD.

The light-emitting device LD outputs light corresponding to the driving current. The light-emitting device LD may be an organic light emitting diode (OLED), or an ultra-small inorganic light emitting diode having a size ranging from micro to nanoscale, but the present exemplary embodiment is not limited thereto. Hereinafter, the technical idea of the present exemplary embodiment will be described with reference to the exemplary embodiment in which the light-emitting device LD is composed of an organic light emitting diode.

In the present exemplary embodiment, the structure of the sub-pixels $sP_{ij}$ is not limited to that shown in FIG. 2. According to the exemplary embodiment, the sub-pixels $sP_{ij}$ compensate for a threshold voltage of the driving transistor DT or may further include at least one device for initializing the voltage of the gate electrode of the driving transistor DT and/or the voltage of the first electrode of the light-emitting device LD.

FIG. 2 shows an example in which the switching transistor ST, the driving transistor DT, and the sensing transistor SST are NMOS transistors, but the present invention is not limited thereto. For example, at least some or all of the transistors constituting each sub-pixel sP may be composed of PMOS transistors. In various exemplary embodiments, each of the switching transistor ST, the driving transistor DT, and the sensing transistor SST may be implemented by a low temperature polysilicon (LTPS) thin film transistor, an oxide thin film transistor, or a low temperature polycrystalline oxide (LTPO) thin film transistor.

Figure 3A:
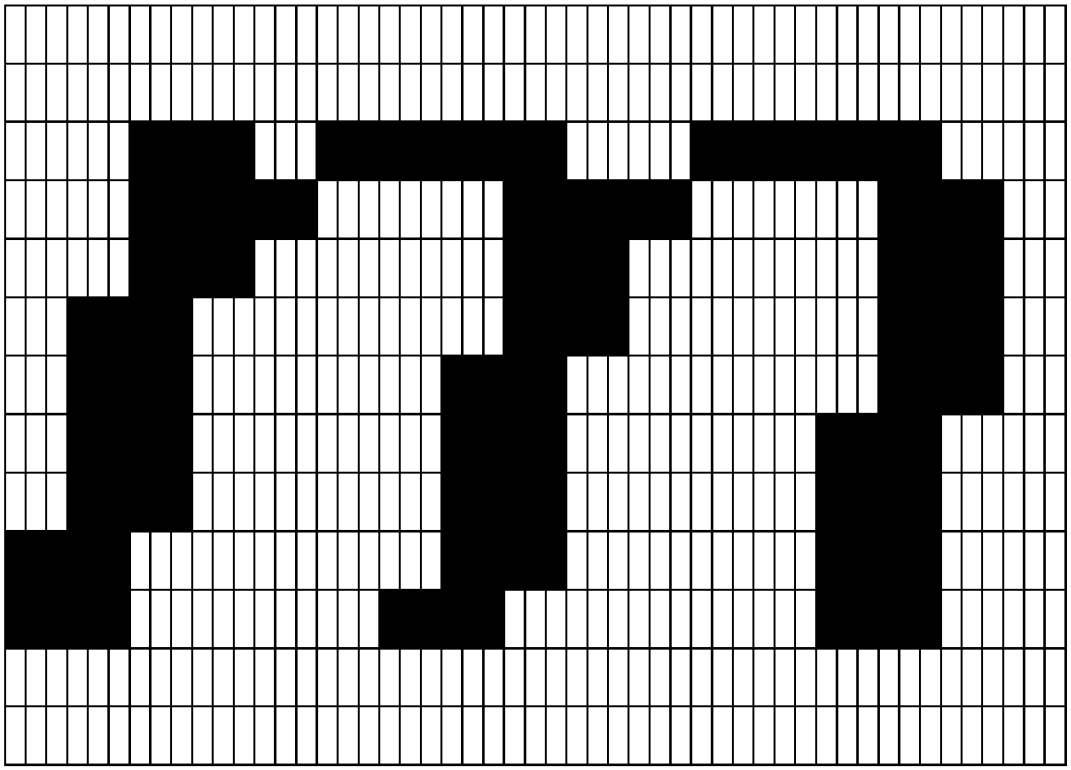
FIGS. 3A and 3B are views respectively showing texts before and after applying ClearType.
Figure 3B:
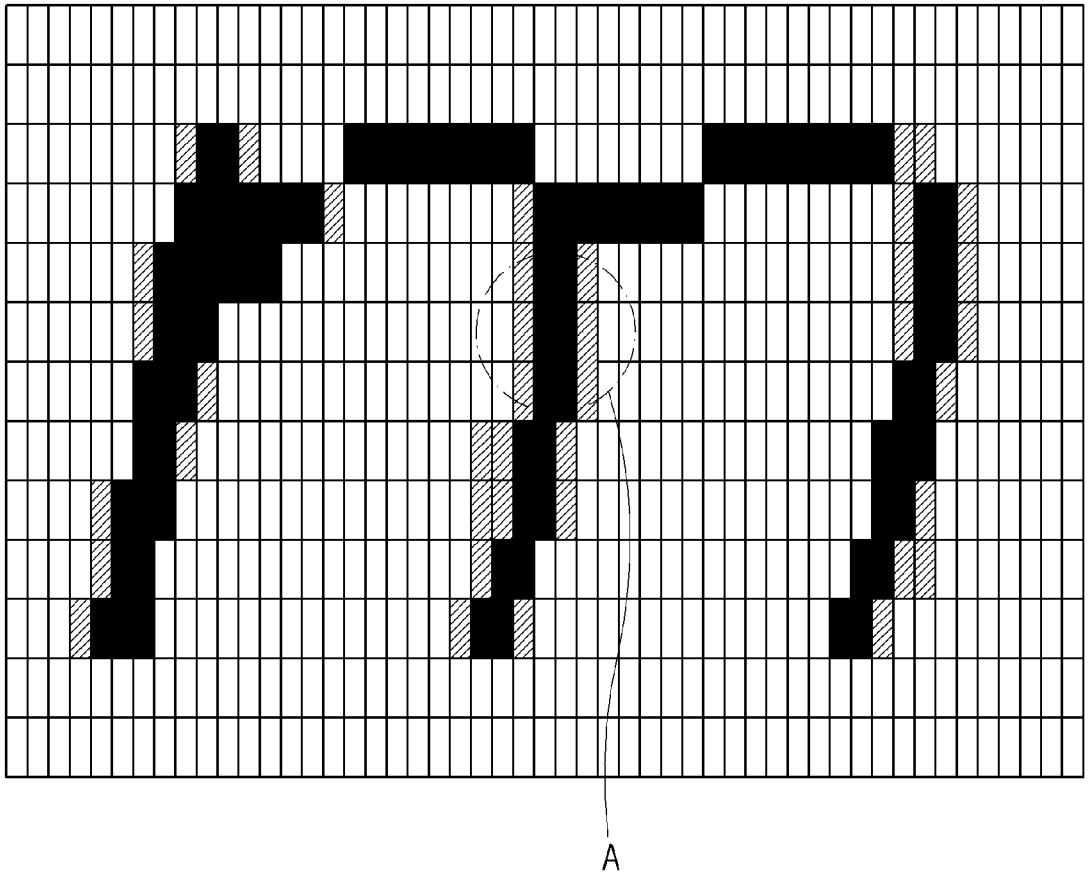
Figure 4:
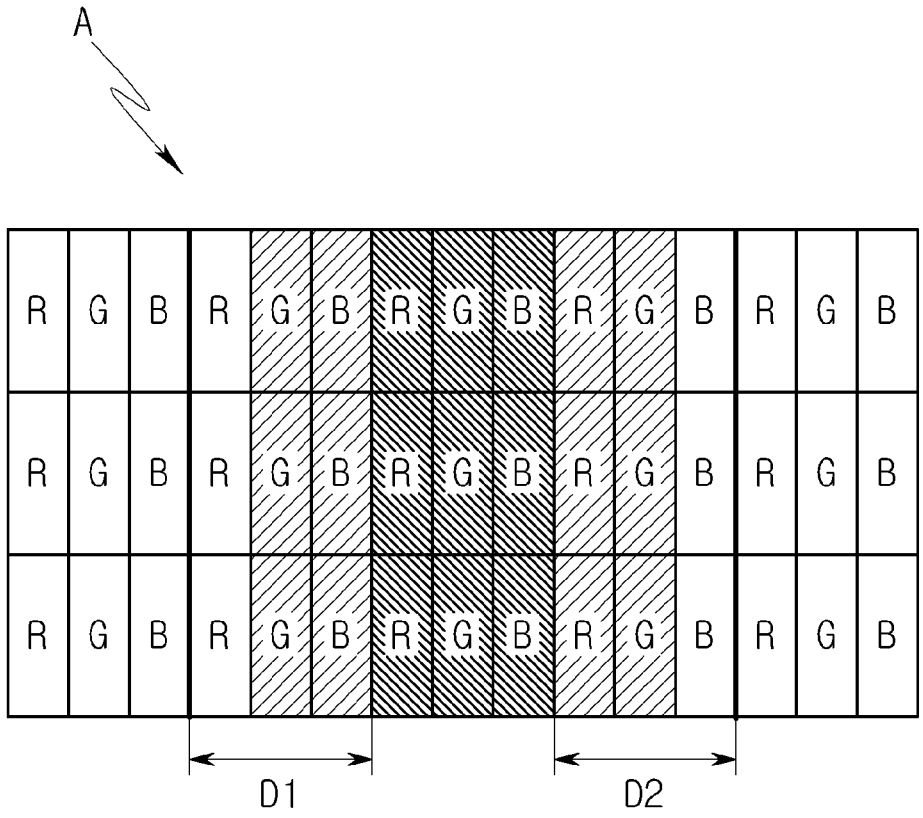
FIG. 4 is an enlarged plan view of part A of FIG. 3B.
Figure 5:
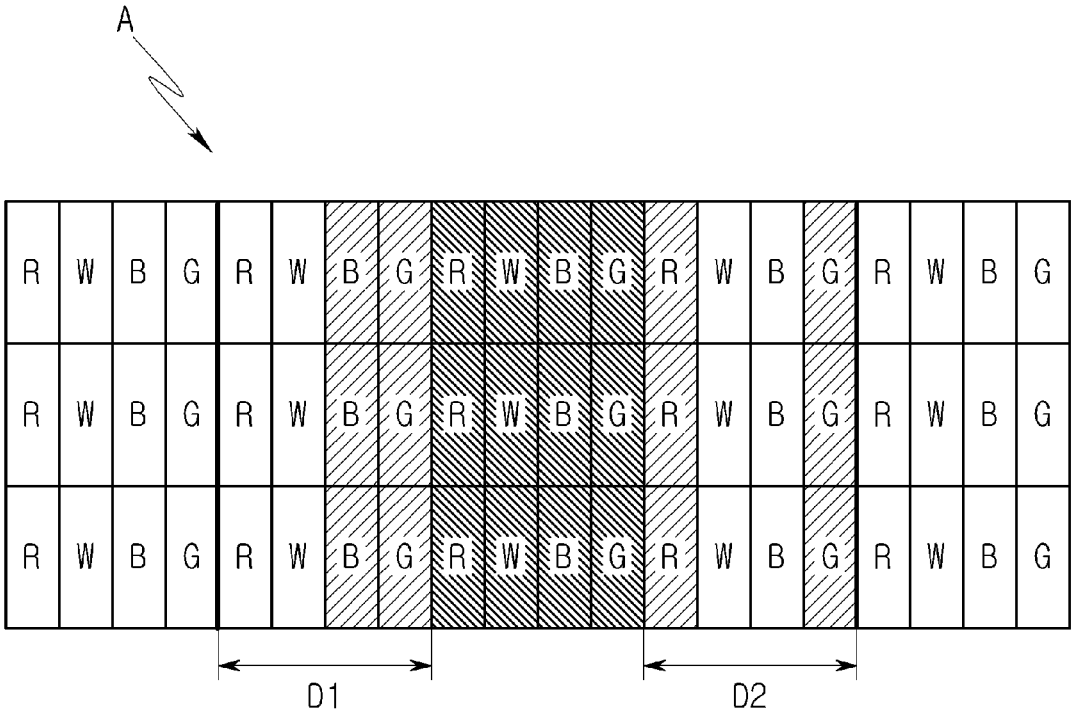
FIG. 5 is an enlarged plan view of part A of FIG. 3B when ClearType is applied to a four-color type display device.

FIGS. 3A and 3B are views respectively showing texts before and after applying ClearType. FIG. 4 is an enlarged plan view of part A of FIG. 3B. FIG. 5 is an enlarged plan view of part A of FIG. 3B when ClearType is applied to a four-color type display device.

FIGS. 3A and 3B show texts before and after applying ClearType in a three-color (i.e., red, green, and blue) type display device. As shown in FIG. 3A, when ClearType is not applied, the text is displayed thickly and unevenly because the text is displayed in units of pixels (i.e., R, G, and B). However, as shown in FIG. 3B, when ClearType is applied, not only a display panel is driven in sub-pixel units, but also the luminance level of text is adjusted, and thus the text may be expressed thin and soft.

Referring to FIG. 4, a left edge D1 of the text is displayed by driving green and blue sub-pixels G and B in a light-emitting state and driving red sub-pixel R in a non-light-emitting state. In addition, a right edge D2 of the text is displayed by driving red and green sub-pixels R and G in the light-emitting state and driving blue sub-pixel B in the non-light-emitting state.

FIG. 5 shows an example in which ClearType is applied in a four-color type display device in which red, white, blue, and green sub-pixels R, W, B, and G are sequentially arranged. When the text shown in FIG. 4 is displayed as ClearType in the four-color type display device, as shown in FIG. 5, white sub-pixels W are controlled in the non-light-emitting state or luminance is changed, whereby resolution of the text may decrease. In addition, when the sub-pixel arrangement order of the four-color type display device is different from the order considered in ClearType (for example, an order of red R, green G, and blue B), ClearType may not be applied correctly.

In order to prevent such a problem, in the following exemplary embodiments, a method of displaying text, to which ClearType is applied in the four-color type display device, without decreasing image quality will be described.

Figure 6:
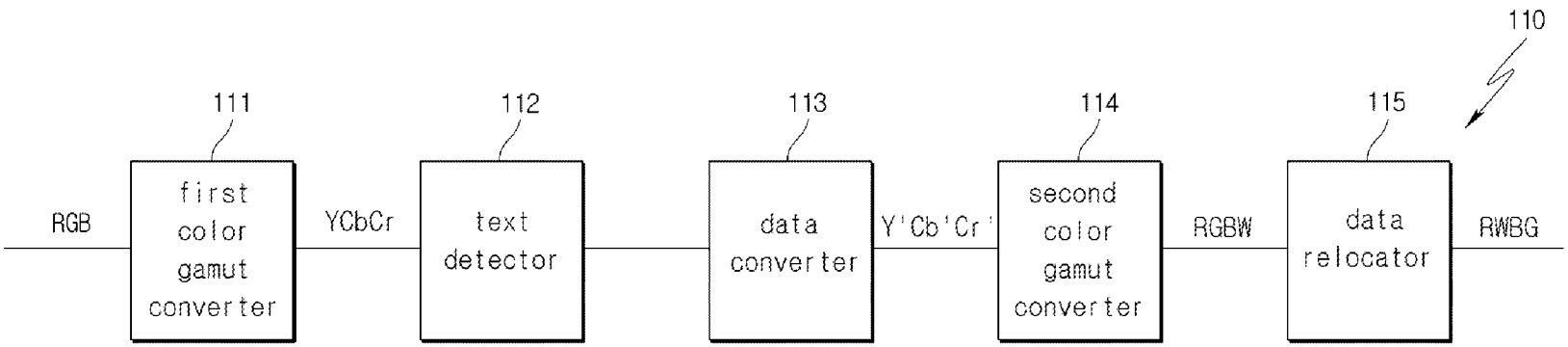
FIG. 6 is a block diagram showing a configuration of an image processor according to the exemplary embodiment.

FIG. 6 is a block diagram showing a configuration of an image processor according to the exemplary embodiment.

Referring to FIG. 6, the image processor 110 may include a first color gamut converter 111, a text detector 112, a data converter 113, a second color gamut converter 114, and a data relocator 115.

The first color gamut converter 111 receives an image signal RGB in units of frames. The image signal RGB input to the first color gamut converter 111 may include at least one text to which ClearType is applied.

The first color gamut converter 111 converts the received image signal RGB of one frame into a color gamut for calculating luminance. The first color gamut converter 111 converts the image signal RGB including each grayscale data of red R, green G, and blue B into the color gamut having a luminance component and a chrominance component. Here, the color gamut after conversion may be, for example, YUV, Y-Pr-Pb, YCbCr, and the like. Hereinafter, exemplary embodiments in which the first color gamut converter 111 converts the image signal RGB into YCbCr will be described as an example.

In the exemplary embodiment, when the image processor 110 processes an image on the basis of a RGB color gamut, the first color gamut converter 111 may be omitted.

The text detector 112 extracts a luminance component and/or a chrominance component from an image signal converted by the first color gamut converter 111, and uses the extracted luminance component and/or chrominance component to detect text in an image. For example, the text detector 112 may calculate edges from the converted image signal YCbCr and detect the text in the image on the basis of the edges. The text detector 112 may calculate the edges in the image through a partial feature extraction technique, for example, a technique using a Sobel mask.

In the exemplary embodiment, when the image processor 110 processes an image on the basis of the RGB color gamut, the text detector 112 calculates the edges on the basis of grayscale values of red R, green G, and blue B, and detects the text accordingly.

In the present exemplary embodiment, the text detector 112 may detect text to which ClearType is particularly applied in an image. A text detection method of the text detector 112 will be described in more detail below with reference to FIGS. 7 and 8.

The data converter 113 converts data for the text detected by the text detector 112. The data may be, for example, the luminance component or the chrominance component. For example, the data converter 113 may decrease the luminance component of the edges of the text. Alternatively, for example, the data converter 113 may convert a chromatic color to an achromatic color by decreasing the chrominance component of the edges of the text.

In the exemplary embodiment, when the image processor 110 processes an image on the basis of the RGB color gamut, the data converter 113 may convert a ratio of grayscale values of red R, green G, and blue B.

A data conversion method of the data converter 113 will be described in more detail below with reference to FIGS. 9A, 9B, and 10.

The second color gamut converter 114 converts the data-converted image signal Y'Cb'Cr' into a color gamut suitable for the display panel 160. For example, the second color gamut converter 114 may convert the luminance component and the chrominance component of the data-converted image signal Y'Cb'Cr' into grayscale values of red R, green G, blue B, and white W.

In the exemplary embodiment, when the image processor 110 processes an image on the basis of the RGB color gamut, the second color gamut converter 114 may convert the data-converted image signal R'G'B' into grayscale values of red R, green G, blue B, and white W.

In the exemplary embodiment, the second color gamut converter 114 may select, as luminance of white W, the luminance of a color having the minimum luminance among red R, green G, and blue B. In addition, the data converter 203 may subtract the luminance of white W from the luminance of red R, green G, and blue B. The data converter 203 may output, as converted image data RGBW, the luminance of colors obtained as described above, including red R, green G, blue B, and white W. However, an image data conversion method of the data converter 203 is not limited to the above-described method.

The data relocator 115 relocates the color gamut-converted image signal RGBW in accordance with a sub-pixel arrangement order of the display panel 160. For example, when the sub-pixel arrangement order of the display panel 160 is red R, white W, blue B, and green G, the data relocator 115 may relocate data of the grayscale values in the image signal RGBW to suit the sub-pixel arrangement order of the display panel 160. According to the exemplary embodiment, the data relocator 115 may exchange grayscale values of sub-pixels with each other or convert the grayscale values according to a predetermined condition.

A data relocation method of the data relocator 115 will be described in more detail below with reference to FIG. 11.

Figure 7A:
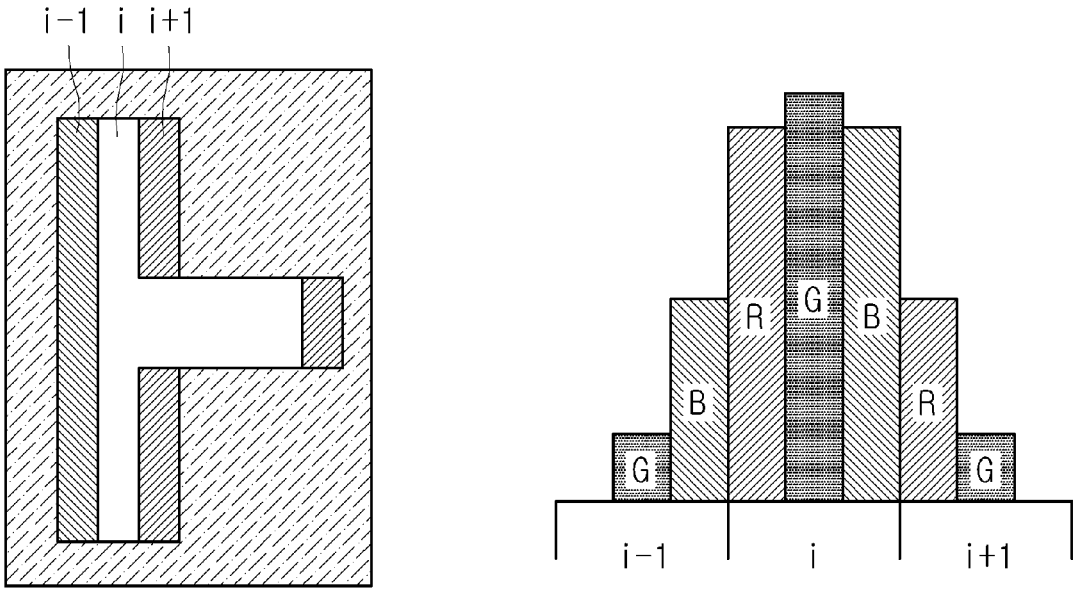
FIGS. 7A, 7B, and 7C are views showing a text detection method according to the exemplary embodiment.
Figure 7B:
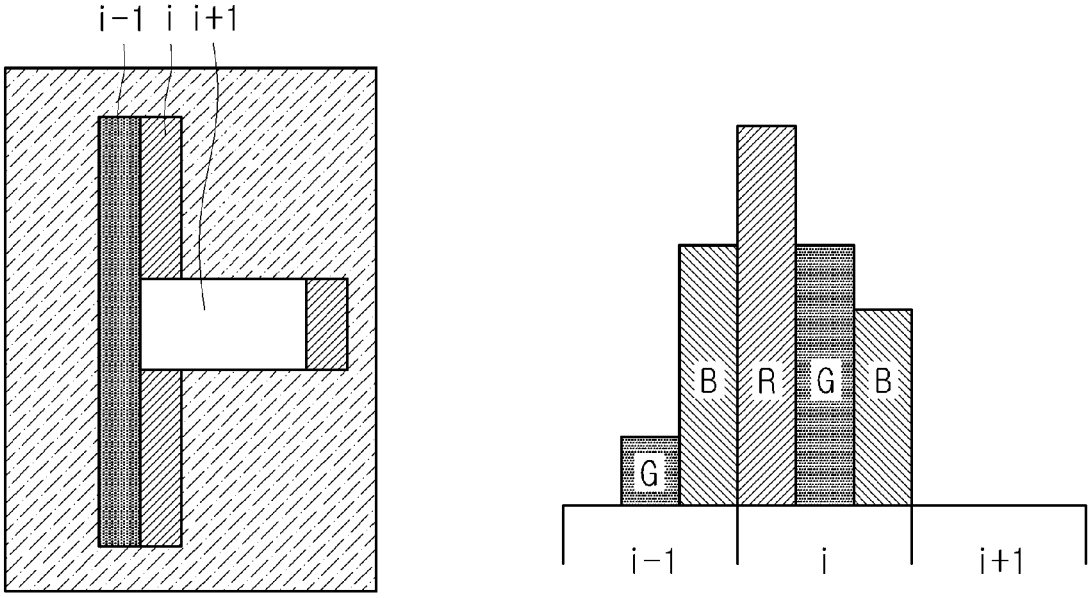
Figure 7C:
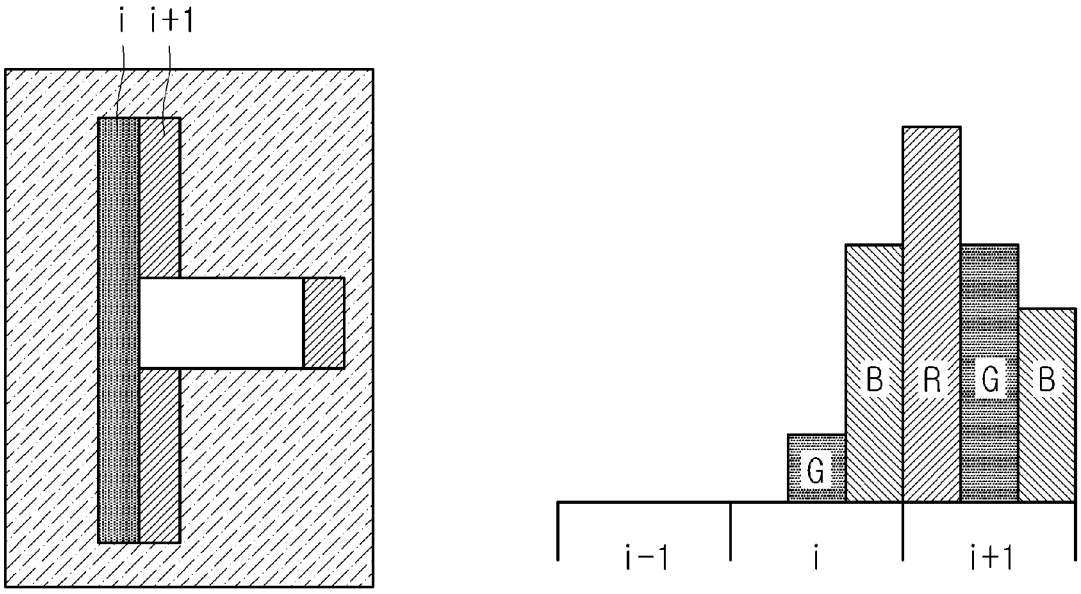

FIGS. 7A to 7C are views showing the text detection method according to the exemplary embodiment. In the exemplary embodiment, the text detector 112 may detect text on the basis of information on the luminance component and/or chrominance component of the image signal YCbCr output from the first color gamut converter 111. That is, in the image signal YCbCr of pixels, the text detector 112 may detect, as text, the pixels satisfying a preset text detection condition.

Referring to FIGS. 7A to 7C, when text is embossed, the text has a higher luminance Y than that of surroundings of the text. In addition, as described with reference to FIG. 4, in the text to which ClearType is applied, since a left edge of the text is driven in a state where green and blue sub-pixels G and B emit light, a Cb component is larger than a Cr component, and since a right edge of the text is driven in a state where red and green sub-pixels R and G emit light, the Cb component is smaller than the Cr component. Conversely, when text is engraved, the text has a lower luminance Y than that of surroundings of the text. In addition, in the left edge of the text, the Cb component is smaller than the Cr component, and in the right edge of the text, the Cb component is larger than the Cr component. Accordingly, the text detector 112 may detect text and edges of the text on the basis of whether luminance is increased or decreased by a preset value between adjacent pixels and on the basis of relative sizes of the Cb component and the Cr component.

In FIGS. 7A to 7C show some exemplary embodiments of an embossed text.

In a first exemplary embodiment shown in FIG. 7A, luminance of a central part of text may be the highest and luminance of edges of the text may be lower than the luminance of the central part of the text. That is, luminance of an i-th pixel is higher than luminance of an (i−1)-th pixel, and luminance of an (i+1)-th pixel is lower than the luminance of the i-th pixel. In addition, a condition of Cb>Cr is satisfied in the (i−1)-th pixel which is a left edge, and a condition of Cr>Cb is satisfied in the (i+1)-th pixel which is a right edge. When the above conditions are satisfied, the text detector 112 may determine that an image signal YCbCr of the (i−1)-th to (i+1)-th pixels is related to an embossed text and the (i−1)-th and (i+1)-th pixels are the edges of the corresponding text.

In second and third exemplary embodiments shown in FIGS. 7B and 7C, the thickness of lines constituting text is thinner than that shown in FIG. 7A. Here, similar to the exemplary embodiment of FIG. 7A, the luminance of the i-th pixel is higher than the luminance the (i−1)-th pixel, and the luminance of the (i+1)-th pixel is lower than the luminance of the i-th pixel.

In the exemplary embodiment of FIG. 7B, a condition of Cb>Cr is satisfied in the (i−1)-th pixel which is the left edge, and a condition of Cr>Cb is satisfied in the i-th pixel which is the right edge. Since a position of text is changed in units of one pixel, in the exemplary embodiment of FIG. 7C, the condition of Cb>Cr is satisfied in the i-th pixel, which is the left edge, and the condition of Cr>Cb is satisfied in the (i+1)-th pixel, which is the right edge.

An exemplary embodiment of an engraved text is not shown separately, but a text detection condition may be set opposite to that of the embossed text. The text detection conditions in the first to third exemplary embodiments for the embossed text and the engraved text are shown in Tables 1 to 3 below.

TABLE 1

| First exemplary embodiment | Embossed letters | | | Engraved letters | | |
|---|---|---|---|---|---|---|
| Pixel position | i − 1 | i | i + 1 | N − 1 | N | N + 1 |
| Chrominance | Cb > Cr | Cb ≡ Cr | Cb < Cr | Cb < Cr | Cb ≡ Cr | Cb > Cr |
| Luminance | Increase | Decrease | | Decrease | Increase | |

TABLE 2

| Second exemplary embodiment | Embossed letters | | | Engraved letters | | |
|---|---|---|---|---|---|---|
| Pixel position | i − 1 | i | i + 1 | N − 1 | N | N + 1 |
| Chrominance | Cb > Cr | Cb < Cr | — | Cb < Cr | Cb > Cr | — |
| Luminance | Increase | Decrease | | Decrease | Increase | |

TABLE 3

| Third exemplary embodiment | Embossed letters | | | Engraved letters | | |
|---|---|---|---|---|---|---|
| Pixel position | i − 1 | i | i + 1 | N − 1 | N | N + 1 |
| Chrominance | — | Cb > Cr | Cb < Cr | — | Cb < Cr | Cb > Cr |
| Luminance | Increase | Decrease | | Decrease | Increase | |

Figure 8A:
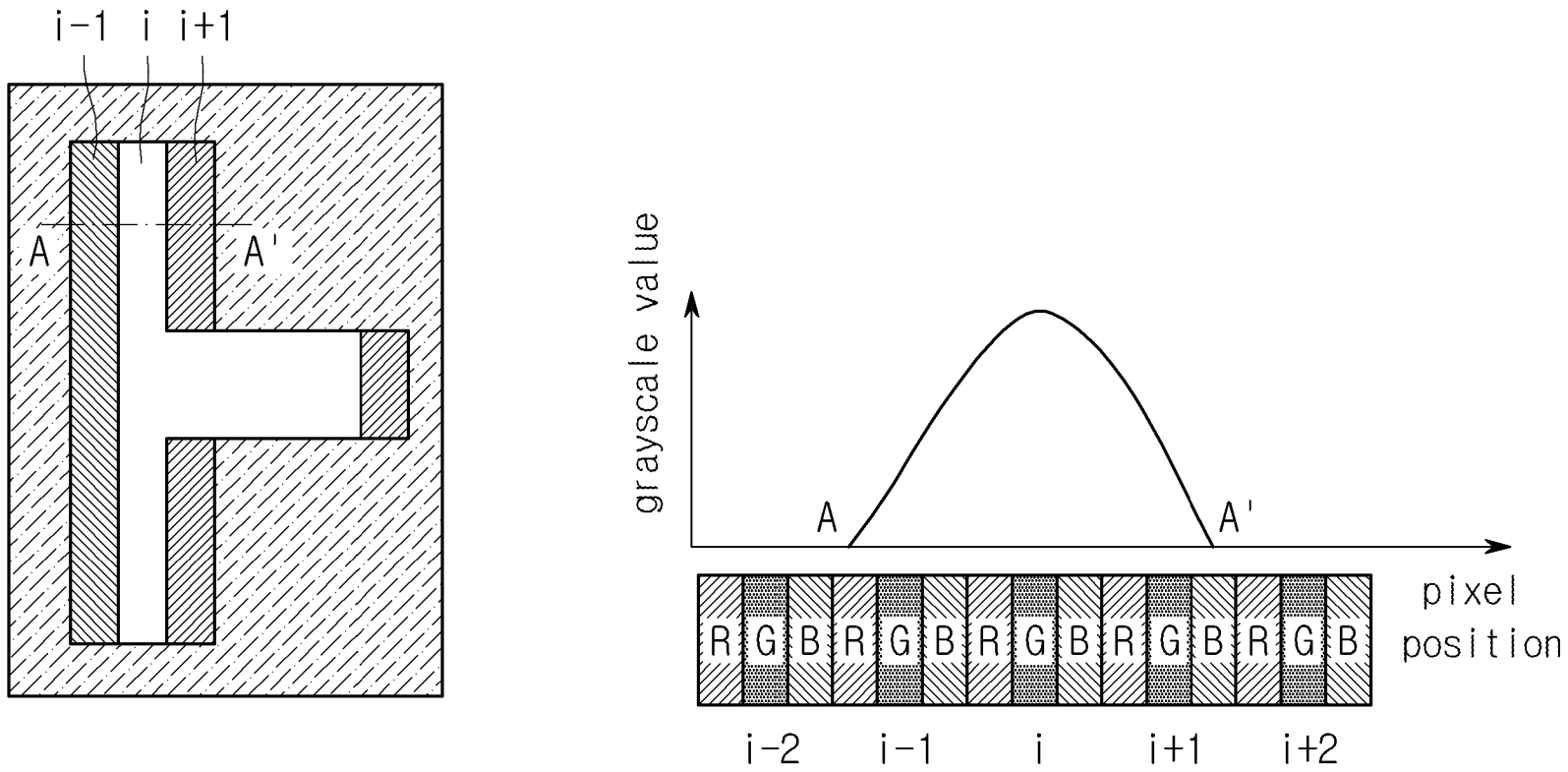
FIGS. 8A, 8B, and 8C are views showing a text detection method according to another exemplary embodiment.
Figure 8B:
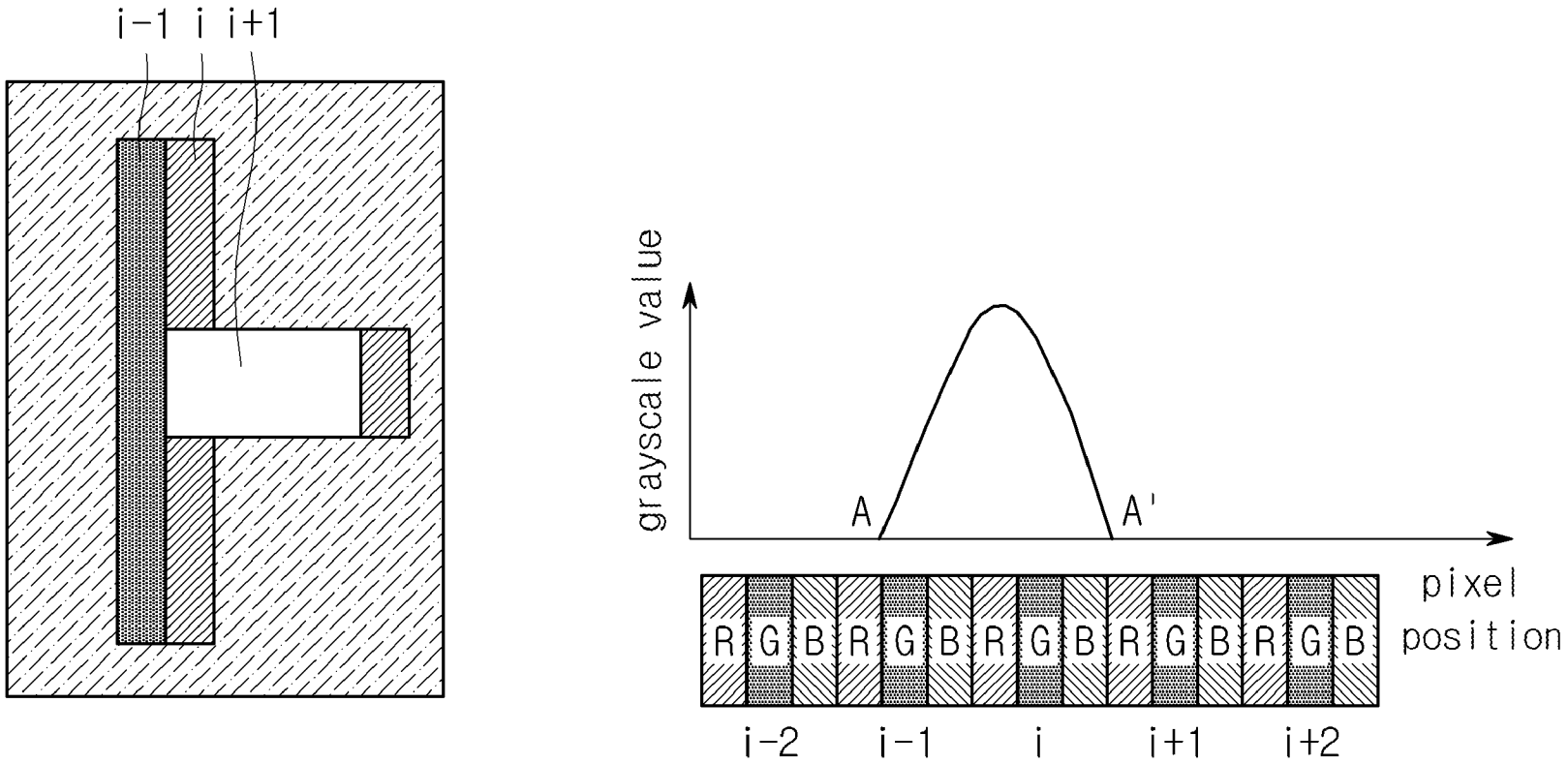
Figure 8C:
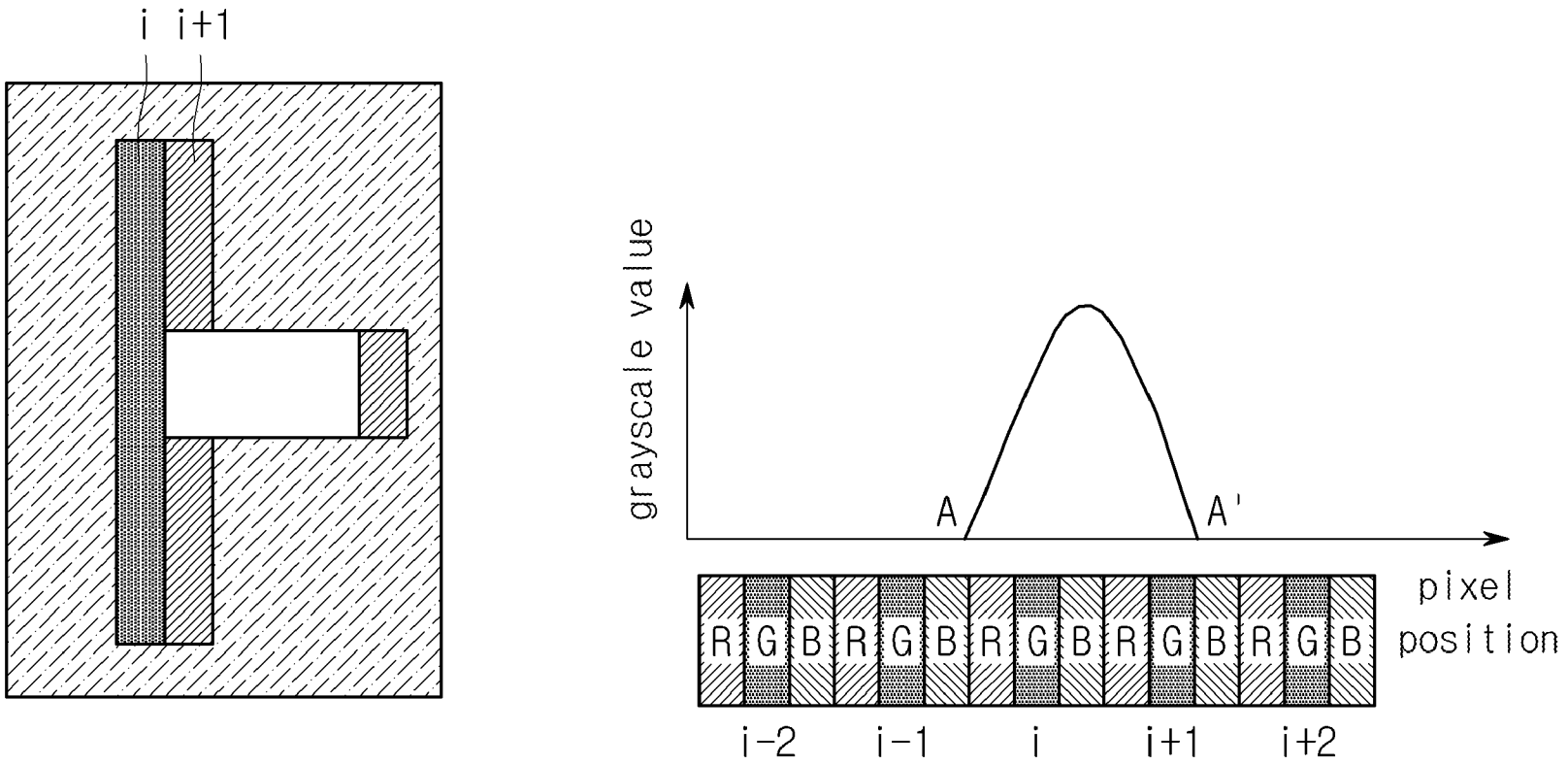

FIGS. 8A to 8C are views showing a text detection method according to another exemplary embodiment. In the exemplary embodiment, an image processor 110 may process an image on the basis of a RGB color gamut. In such an exemplary embodiment, a text detector 112 may detect text on the basis of grayscale values of colors including red R, green G, and blue B, the colors constituting an image signal RGB. That is, in the image signal RGB of pixels, the text detector 112 may detect, as the text, the pixels satisfying a preset text detection condition.

Referring to FIGS. 8A to 8C, when the text is embossed, the text has a higher grayscale value than that of surroundings of the text. That is, the grayscale value is the largest at a central part of the text, and the grayscale value is the smallest at edges of the text. Conversely, when the text is engraved, the grayscale value is the largest at the edges of the text and the grayscale value is the smallest at the central part of the text. Accordingly, the text detector 112 may detect the text and the edges of the text by comparing grayscale values between adjacent sub-pixels.

FIGS. 8A to 8C show some exemplary embodiments of embossed texts.

In the first exemplary embodiment shown in FIG. 8A, the grayscale value in the central part of the text is the largest, and the grayscale value decreases toward each of both edges of the text. That is, the grayscale value of the (i−1)-th green sub-pixel G is determined to be less than or equal to the grayscale value of the (i−1)-th blue sub-pixel B. In addition, the grayscale value of the (i−1)-th blue sub-pixel B is determined to be less than or equal to the grayscale value of the i-th red sub-pixel R. In addition, the grayscale value of the i-th blue sub-pixel B is determined to be greater than or equal to the grayscale value of the (i+1)-th red sub-pixel R. In addition, the grayscale value of the (i+1)-th red sub-pixel G is determined to be greater than or equal to the grayscale value of the (i+1)-th green sub-pixel G. In this case, the maximum grayscale value exists in the i-th pixel among the (i−1)-th to (i+1)-th pixels. When the above conditions are satisfied, the text detector 112 may determine that the image signal RGB of the (i−1)-th to (i+1)-th pixels is related to the embossed text and also the (i−1)-th and (i+1)-th pixels are the edges of the corresponding text.

In the second and third exemplary embodiments shown in FIGS. 8B and 8C, the thickness of the lines constituting the text is thinner than that shown in FIG. 8A. Except for each position of sub-pixels at which each grayscale value changes, the exemplary embodiments of FIGS. 8B and 8C are substantially the same as the exemplary embodiment of FIG. 8A, and thus a duplicate description will be omitted. Although the exemplary embodiment of the engraved text is not separately illustrated, the text detection condition may be set opposite to that of the embossed text.

Figure 9A:
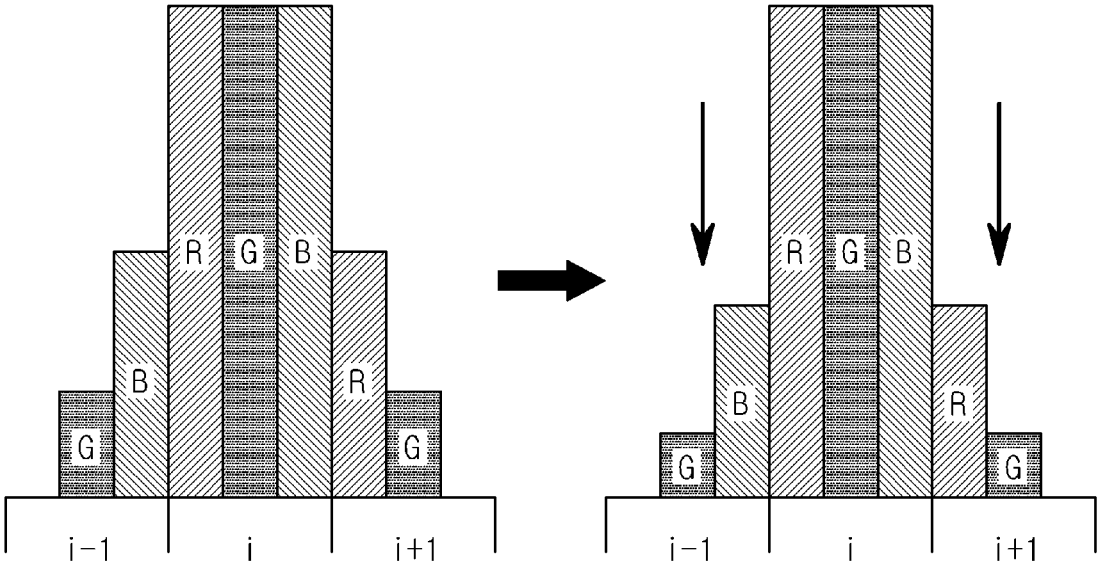
FIGS. 9A and 9B are views showing a data conversion method according to the exemplary embodiment.
Figure 9B:
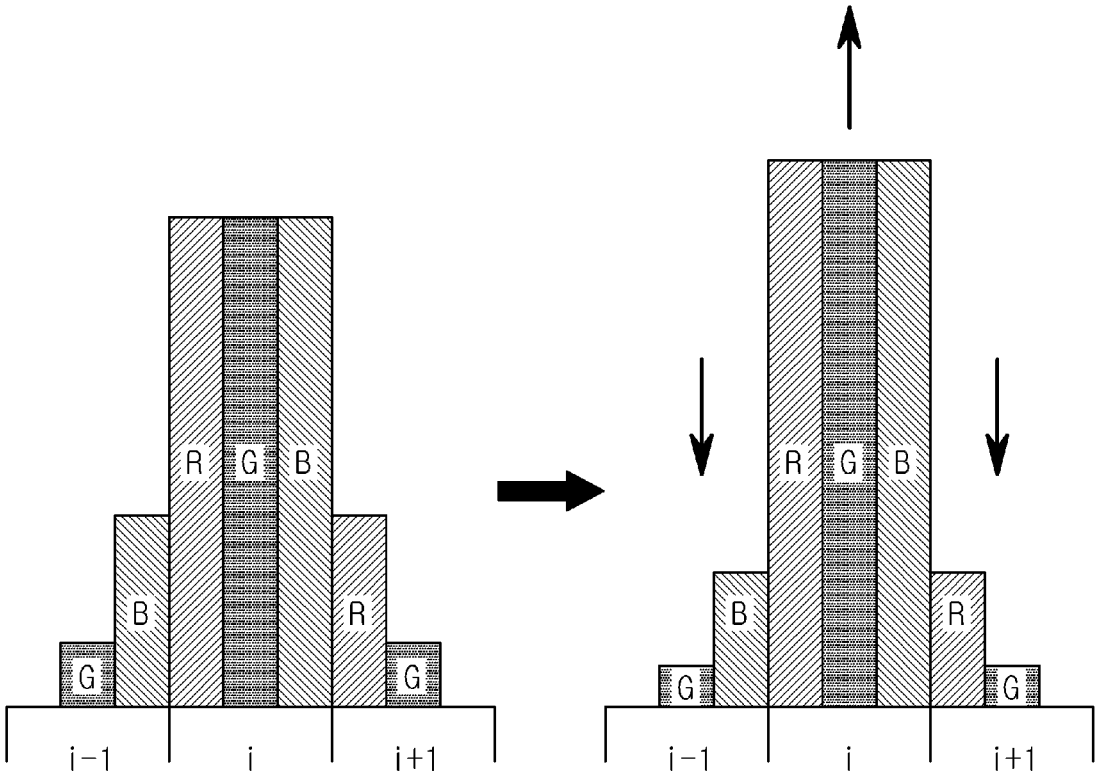

FIGS. 9A and 9B are views showing the data conversion method according to the exemplary embodiment. In the exemplary embodiment, the data converter 113 converts data of edges in the text detected by the text detector 112.

In the exemplary embodiment shown in FIG. 9A, the data converter 113 may convert a chrominance component of each edge. That is, the data converter 113 may decrease the chrominance component of each edge of the text. By decreasing the chrominance component of each edge, a color component of each edge rendered in ClearType may be decreased so as to be approximated to an achromatic color. Such data conversion makes it possible to prevent readability decrease due to edge squashing of a ClearType text in the four-color type display device having difficulty in applying ClearType.

When the display panel 160 expresses 128 grayscales, decrease of the chrominance component for the embossed text shown in FIG. 7A may be performed by Equation 1 below. Equation 1 is disclosed for a Cb component, but the same equation may be applied to a Cr component as well.

$$Cb(i-1)=(Cb(i-1)-128)/2+128$$

$$Cb(i)=Cb(i)$$

$$Cb(i+1)=(Cb(i+1)-128)/2+128 \quad \text{[Equation 1]}$$

Meanwhile, decrease of the chrominance component for the embossed text shown in FIG. 7B may be performed by Equation 2 below. In the case of the embossed text shown in FIG. 7C, only the position of each edge part is different from that of the exemplary embodiment shown in FIG. 7B, whereby the decrease of the chrominance component may be applied according to Equation 2.

$$Cb(i-1)=(Cb(i-1)+b(i))/2$$

$$Cb(i)=(Cb(i-1)+b(i))/2 \quad \text{[Equation 2]}$$

In various exemplary embodiments, the data converter 113 may decrease the chrominance component of each edge as described above with respect to the embossed text.

In the exemplary embodiment shown in FIG. 9B, the data converter 113 may convert the luminance component of each edge. That is, the data converter 113 may increase the luminance component of the central part of the text and decrease the luminance component of each edge of the text. By converting the luminance component of each edge, the luminance of each edge rendered in ClearType is decreased and the luminance of the central part of the text is increased, whereby it is possible to improve text readability.

Decrease of the luminance component for text may be performed by the following Equation 3.

$$Y(i-1)=Y(i-1)-w1\times Y(i)$$

$$Y(i)=-w2Y(i-1)+w2\times Y(i)-w3\times Y(i+1)$$

$$Y(i+1)=Y(i+1)-w4\times Y(i) \quad \text{[Equation 3]}$$

Here, w1 to w4 are predetermined gain values optimized to improve text readability.

In various exemplary embodiments, the data converter 113 may decrease the luminance component of each edge as described above with respect to the engraved text.

Figure 10:
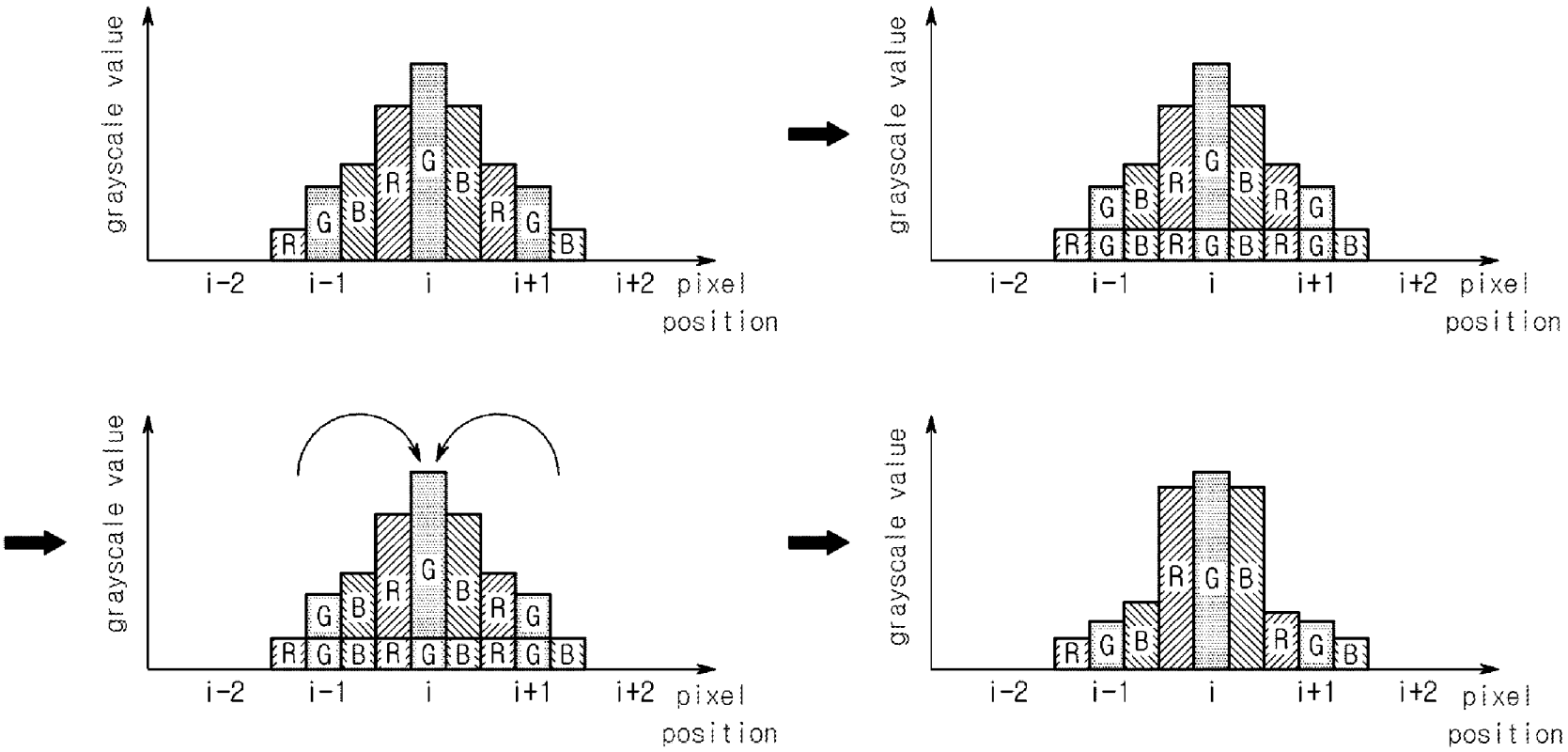
FIG. 10 is a view showing a data conversion method according to another exemplary embodiment.

FIG. 10 is a view showing a data conversion method according to another exemplary embodiment. In the exemplary embodiment, an image processor 110 may process an image on the basis of a RGB color gamut. In such an exemplary embodiment, a data converter 113 converts grayscale data of edges in text detected by a text detector 112. That is, the data converter 113 may increase a grayscale value of a central part of the text and decrease a grayscale value of each edge of the text. In this case, the data converter 113 may increase or decrease the grayscale value so that a ratio of each grayscale value of red R, green G, and blue B in the central part and both edges of the text is approximated to the ratio of 1:1:1.

Referring to FIG. 10, the data converter 113 may increase grayscale values by applying predetermined gain values to the grayscale values for red R, green G, and blue B of the central part of the text. In this case, the data converter 113 may increase grayscale values by adding, as a background grayscale value, a predetermined ratio of the grayscale values of both edge parts to the grayscale values of the central part of the text A grayscale value increase method is expressed as Equation 4 below.

$$R(i)=R(i)+R(i-1)\times(1-\text{gain_}p)+R(i+1)\times(1-\text{gain_}n)$$

$$G(i)=G(i)+G(i-1)\times(1-\text{gain_}p)+G(i+1)\times(1-\text{gain_}n)$$

$$B(i)=B(i)+B(i-1)\times(1-\text{gain_}p)+B(i+1)\times(1-\text{gain_}n) \quad \text{[Equation 4]}$$

Here, R, G, and B refer to grayscale values in each corresponding sub-pixel, and gain_p and gain_n are predetermined gain values optimized to improve text readability.

The data converter 113 may decrease grayscale values by applying predetermined gain values to the grayscale values of red R, green G, and blue B of the edges of the text. The grayscale value decrease method is expressed as Equation 5 below.

$$R(i-1)=R(i-1)\times\text{gain_}p$$

$$G(i-1)=G(i-1)\times\text{gain_}p$$

$$B(i-1)=B(i-1)\times\text{gain_}p$$

$$R(i+1)=R(i+1)\times\text{gain_}n$$

$$G(i+1)=G(i+1)\times\text{gain_}n$$

$$B(i+1)=B(i+1)\times\text{gain_}n \quad \text{[Equation 5]}$$

Figure 11:
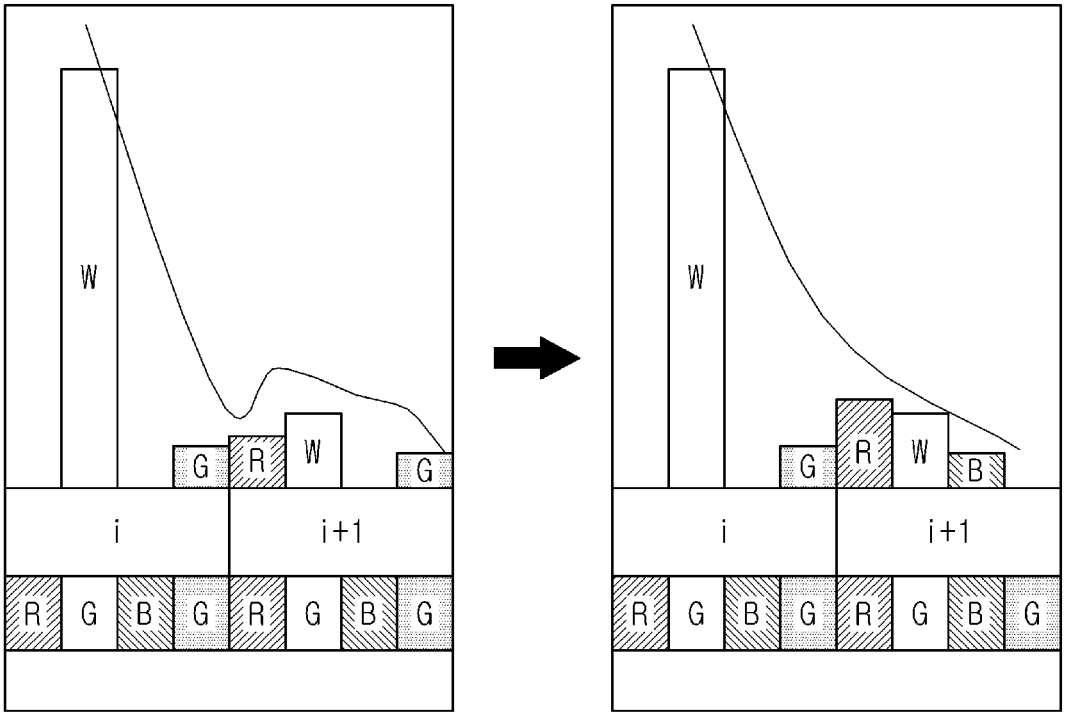
FIG. 11 is a view showing a data relocation method according to the exemplary embodiment.

FIG. 11 is a view showing the data relocation method according to the exemplary embodiment. In the exemplary embodiment, the data relocator 115 may relocate the image signal RGBW that is color gamut-converted by the second color gamut converter 114. In this case, the data relocator 115 may convert the grayscale value according to a predetermined condition.

In the exemplary embodiment, the sub-pixel arrangement order of the display panel 160 may be red R, white W, blue B, and green G. The data relocator 115 may relocate data of the grayscale values of red R, green G, blue B, and white W, which are included in the converted image signal according to the sub-pixel arrangement order of the display panel 160.

In general, when text is expressed, as described above, the luminance and grayscale are highest in the central part of the text, and the luminance and grayscale may be gradually decreased toward each of the both edges of the text. When the data of grayscale values is relocated, such luminance and grayscale distribution may be modified, thereby causing image quality decrease.

For example, a right edge of a ClearType text has red R and green G grayscales, and as shown in FIG. 11, when sub-pixels of red R, white W, and green G among the sub-pixels in the order of red R, white W, blue B, and green are driven in a light-emitting state by image signal conversion, a blue B sub-pixel in a non-light-emitting state may be recognized as a stripe. In addition, when a focus is moved from the central part to each edge of the text, the luminance and grayscale distribution in a specific sub-pixel increase rather than decrease, whereby it is possible to cause visual heterogeneity.

In order to prevent such a problem, the data relocator 115 may convert the grayscale value. For example, for a right edge of text, the data relocator 115 may convert a grayscale value of green G into a grayscale value of blue B. In addition, the data relocator 115 may correct the grayscale values for sub-pixels constituting each edge so that the grayscale values gradually decrease as the distance from the central part to each sub-pixel of the text increases.

In the present exemplary embodiment, the ClearType text includes the central part and the both edges by the data relocation as described above, wherein each edge is expressed by means of at least three sub-pixels that are adjacent to the central part and driven in the light-emitting state. For example, in the left edge, white, blue, and green sub-pixels adjacent to the central part are driven in the light-emitting state, and in the right edge, red, white, and blue sub-pixels adjacent to the central part are driven in the light-emitting state. In this case, the luminance and grayscale values of the central part have maximum values, and the luminance and grayscale values of the sub-pixels at each edge gradually decrease as the distance from the central part to each sub-pixel increases.

Although the exemplary embodiments of the present invention have been described above with reference to the accompanying drawings, it will be understood that those skilled in the art to which the present invention pertains may implement the technical structure of the present invention in other specific forms without departing from the technical spirit or essential features thereof. Therefore, the exemplary embodiments described above are to be understood in all respects as illustrative and not restrictive. The scope of the present invention is indicated by the following claims rather than the above detailed description. In addition, all changes or modifications derived from the meaning and scope of the claims and equivalent concepts should be interpreted as being included in the claims of the present disclosure.

What is claimed is:

1. A display device comprising unit pixels in which red, white, blue, and green sub-pixels are sequentially arranged, the display device comprising:

an image processor configured to detect text from an image signal input from outside, perform image processing on the text, and output the text, wherein the image processor performs the image processing so that predetermined sub-pixels adjacent to a central part of the text are driven in a light-emitting state in the unit pixels respectively corresponding to both edges of the text, and wherein the image processor performs the image processing so that the white, blue, and green sub-pixels are driven in the light-emitting state in the unit pixels corresponding to a left edge of the text, and the red, white, and blue sub-pixels are driven in the light-emitting state in the unit pixels corresponding to a right edge of the text.

2. The display device of claim 1, wherein the image signal comprises grayscale data for the red, green, and blue sub-pixels.

3. The display device of claim 2, wherein the image processor comprises:

a text detector configured to detect the text from the image signal;

a data converter configured to convert at least one of a luminance component, a chrominance component, and a grayscale value of the detected text; and a data relocator configured to relocate the converted image signal according to an arrangement order of the sub-pixels.

4. The display device of claim 3, further comprising:

a first color gamut converter configured to convert the image signal into a YCbCr color gamut having the luminance component, a first chrominance component, and a second chrominance component, wherein, when the first chrominance component is greater than the second chrominance component in a first unit pixel, and the first chrominance component is smaller than the second chrominance component in a second unit pixel adjacent to the first unit pixel, and the luminance component has a maximum value in a third unit pixel arranged between the first unit pixel and the second unit pixel, the text detector detects the first unit pixel as the left edge and detects the second unit pixel as the right edge.

5. The display device of claim 3, wherein, when the grayscale value gradually increases or decreases and then gradually decreases or increases among a first unit pixel, a second unit pixel adjacent to the first unit pixel, and a third unit pixel adjacent to the second unit pixel, the text detector detects the first unit pixel as the left edge and detects the third unit pixel as the right edge.

6. The display device of claim 3, wherein the data converter decreases at least one of the chrominance component, the luminance component, and the grayscale value of each of both of the edges.

7. The display device of claim 3, wherein the data converter further increases at least one of the luminance component and the grayscale value of the central part.

8. The display device of claim 7, wherein the data converter adjusts grayscale values so that a ratio of each grayscale value of red, green, and blue in the central part and both of the edges is approximated to 1:1:1.

9. The display device of claim 8, wherein the data relocator corrects the relocated data from the converted image signal so that the luminance and grayscale are highest in the central part and the luminance and grayscale gradually decrease toward each of both of the edges.

10. The display device of claim 8, wherein for the right edge, the data relocator converts green grayscale data into blue grayscale data.

11. The display device of claim 1, wherein the text is a ClearType text.

12. A display device comprising:

a display panel comprising unit pixels in which red, white, blue, and green sub-pixels are sequentially arranged;

an image processor configured to detect text from an image signal input from outside, perform image processing on the text, and output the text;

a timing controller configured to process and output the image signal received from the image processor according to an operation condition of the display panel; and a data driver configured to apply, to the sub-pixels, a data signal corresponding to the image signal received from the timing controller, wherein in the unit pixels respectively corresponding to both edges of the text, the display panel emits light of predetermined sub-pixels adjacent to a central part of the text and wherein the predetermined sub-pixels comprise the white, blue, and green sub-pixels in the unit pixels corresponding to a left edge of the text, and comprise the red, white, and blue sub-pixels in the unit pixels corresponding to a right edge of the text.

13. The display device of claim 12, wherein the image signal comprises red, green, and blue grayscale data.

14. The display device of claim 13, wherein the image processor comprises:

a first color gamut converter configured to convert the red, green, and blue grayscale data into data having a luminance component, a first chrominance component, and a second chrominance component;

a text detector configured to detect the text from the converted data;

a data converter configured to convert at least one of the luminance component and the chrominance components of the detected text;

a second color gamut converter configured to convert the converted data into red, green, blue, and white grayscale data; and a data relocator configured to relocate the converted red, green, blue, and white grayscale data in an order of red, white, blue, and green grayscale data.

15. The display device of claim 14, wherein the data converter decreases at least one of the chrominance component, the luminance component, and a grayscale value of each of both of the edges.

16. The display device of claim 15, wherein the data converter further increases the luminance component of the central part.

17. The display device of claim 14, wherein the data converter adjusts the grayscale value so that a ratio of each grayscale value of red, green, and blue in the central part and both of the edges is approximated to 1:1:1.

18. The display device of claim 14, wherein the data relocator corrects the relocated data from the converted image signal so that the luminance and grayscale are highest in the central part and the luminance and grayscale gradually decrease toward each of both of the edges, and converts, for the right edge, green grayscale data into blue grayscale data.

* * * * *